US005466315A

United States Patent [19]

Erickson et al.

[11] Patent Number: 5,466,315

[45] Date of Patent: Nov. 14, 1995

[54] NON-TOXIC PRIMER FOR CENTER-FIRE CARTRIDGES

[75] Inventors: Jack A. Erickson, Andover; Robert L. Kramer, Minneapolis; John M. Hallis, Buffalo, all of Minn.

[73] Assignee: Federal-Hoffman, Inc., Anoka, Minn.

[21] Appl. No.: 301,347

[22] Filed: Sep. 6, 1994

[51] Int. Cl.[6] ..... C06B 25/18

[52] U.S. Cl. ..... 149/96; 149/98; 149/99; 149/105; 149/36

[58] Field of Search ..... 149/36, 96, 98, 149/99, 105

[56] References Cited

U.S. PATENT DOCUMENTS

| | | |
|---|---|---|
| 3,420,137 | 1/1969 | Staba . |
| 3,423,259 | 1/1969 | Staba . |
| 3,499,386 | 3/1970 | Stadler et al. . |
| 3,707,411 | 12/1972 | Gawlick . |
| 3,874,921 | 4/1975 | Todd . |
| 4,363,679 | 12/1982 | Hagel et al. . |
| 4,581,082 | 4/1986 | Hagel et al. . |
| 4,608,102 | 8/1986 | Krampen et al. . |
| 4,674,409 | 6/1987 | Lopata et al. . |
| 4,675,059 | 6/1987 | Mei . |
| 4,689,185 | 8/1987 | Lopata et al. . |
| 4,880,483 | 11/1989 | Baldi . |
| 4,963,201 | 10/1990 | Bjerke et al. . |
| 5,167,736 | 12/1992 | Mei et al. . |
| 5,216,199 | 6/1993 | Bjerke et al. . |

*Primary Examiner*—Donald P. Walsh
*Assistant Examiner*—Anthony R. Chi
*Attorney, Agent, or Firm*—Schroeder & Siegfried

[57] ABSTRACT

A non-toxic primer composition for center-fire cartridges which provides improved ballistic data and is void of metallic oxidizing compounds. It is comprised of a mixture of about 10–30% by weight of nitrocellulose and/or a double based propellant such as Hercules Fines, approximately 30–75% by weight of two percussion-sensitive compounds such as DDNP and tetracene, and approximately 10–30% by weight of calcium silicide. The mixture provides improved propellant ignition and non-toxic ignition products, and minimizes misfires in that it contains no hygroscopic compounds.

33 Claims, No Drawings

NON-TOXIC PRIMER FOR CENTER-FIRE CARTRIDGES

BACKGROUND OF THE INVENTION

This invention provides an improved non-toxic primer mix for small arms center-fire ammunition which is free of metallic oxidizing compounds and of hygroscopic compounds. The need for such a non-toxic primer mix is well established, because there is a great deal of indoor shooting which requires that the air be free of the dust or oxides of any and all toxic elements. Thus, it is highly desirable that all toxic metals be eliminated from the primer mixes which are utilized in the ammunition which is expended in such indoor shooting.

In the past, the primers of small arms ammunition contained mercury, lead, potassium chlorate, antimony, and various other chemicals which were both toxic and corrosive. During the 1930's, these objectionable chemicals were replaced by other materials which were more chemically stable and did not corrode steel gun barrels. These replacement primers contained lead, barium, antimony, and aluminum metallic compounds. They were very stable chemically and were non-corrosive to firearms.

Over the ensuing years, because of environmental and health concerns, the demand has arisen that there be no mercury, lead, barium, antimony, beryllium, cadmium, arsenic, chromium, selenium, tin, or thallium included in such primer mixes. Additional elements which have been considered undesirable by the Environmental Protection Agency (EPA) are zinc and copper and, therefore, they, too, have been included as undesirable components of primers.

Over the preceding years, many attempts have been made to solve the toxicity problems described above and which are still currently being experienced in the field. As a result, a substantial number of U.S. patents have issued, each claiming benefits in performance and, in many instances, with respect to toxicity. None of these patents, to the best of our knowledge, accomplish non-toxicity, in that almost all of them utilize metallic oxidizing compounds which are either toxic or have other undesirable characteristics. For example, U.S. Pat. No. 2,689,788 utilizes ferric styphnate, lead styphnate, barium nitrate, and glass.

U.S. Pat. No. 4,363,679 utilizes zinc peroxide, calcium silicide, magnesium, nickel, and titanium.

U.S. Pat. No. 4,581,082 utilizes strontium nitrate, diazodinitrophenol, tetracene, and a propellant.

U.S. Pat. No. 4,608,102 utilizes DDNP, tetracene, nitrocellulose, aluminum, manganese dioxide, zinc dioxide, and zinc oxide.

U.S. Pat. No. 4,674,409 utilizes DDNP, tetracene, manganese dioxide, and glass.

U.S. Pat. No. 4,675,059 utilizes DDNP, tetracene, manganese dioxide, and glass.

U.S. Pat. No. 4,963,201 utilizes DDNP, tetracene, a propellant, and strontium nitrate.

U.S. Pat. No. 5,167,736 utilizes DDNP, tetracene, a propellant, calcium carbonate, and boron, the latter being at the core of the invention.

U.S. Pat. No. 4,689,185 utilizes DDNP, tetracene, magnanese dioxide and glass.

U.S. Pat. No. 5,216,199 utilizes DDNP, tetracene, strontium nitrate, glass and a suitable propellant.

U.S. Pat. No. 2,409,201 utilizes aluminum zinc oxide and $FeCl_3$.

U.S. Pat. No. 2,123,691 utilizes barium oxide, manganese, selenium, HgCl, potassium chlorate and carbon.

U.S. Pat. No. 4,566,921 utilizes Hg, nitrotetrozole, potassium chlorate, PbSCN, $Sb_2S_3$ and PETN.

U.S. Pat. No. 4,508,580 utilizes barium nitrate, ferric oxide, Mg/Al, strontium, lead oxide and $Fe_2O_2$.

U.S. Pat. No. 4,405,392 utilizes sodium styphnate, $PBHPO_2$, $PB(No_3)_2$ and tetracene.

U.S. Pat. No. 4,376,002 utilizes, among others, ferric oxide, $MnO_2$ and $SnO_2$.

U.S. Pat. No. 4,349,612 utilizes zinc oxide and sodium hydroxide, among others.

U.S. Pat. No. 3,625,855 utilizes manganese and zinc oxide.

U.S. Pat. No. 3,320,104 utilizes barium nitrate and aluminum oxide along with barium sulfate and graphite.

U.S. Pat. No. 3,310,569 utilizes lead styphnate along with tetracene, barium nitrate, lead oxide and glass.

U.S. Pat. No. 2,262,818 utilizes DDNP, tetracene and lead nitrate along with glass.

U.S. Pat. No. 3,087,428 utilizes barium nitrate along with lead sulfide.

U.S. Pat. No. 3,257,892 utilizes barium nitrate and lead oxide along with tetracene, PETN and others.

U.S. Pat. No. 3,420,137 utilizes tetracene, PETN, aluminum and styphnate.

U.S. Pat. No. 3,499,386 utilizes barium nitrate and lead oxide as well as ferric oxide.

U.S. Pat. No. 3,321,343 utilizes barium nitrate along with tetracene and others.

U.S. Pat. No. 4,608,102 utilizes DDNP, tetracene, manganese dioxide and zinc dioxide along with others.

U.S. Pat. No. 3,423,259 utilizes calcium silicide and karaya gum.

U.S. Pat. No. 3,348,985 utilizes $NH_4NO_3$, potassium nitrate, and other oxides.

U.S. Pat. No. 3,862,866 utilizes potassium chlorate and sucrose.

U.S. Pat. No. 4,363,679 utilizes zinc oxide and calcium silicide.

U.S. Pat. No. 4,247,494 utilizes barium nitrate, tetracene and lead oxide along with others.

U.S. Pat. No. 4,412,492 utilizes lead nitrate along with tetracene and other oxides.

U.S. Pat. No. 4,432,819 utilizes lead nitrate with others.

U.S. Pat. No. 4,608,102 utilizes DDNP, tetracene and manganese dioxide.

U.S. Pat. No. 3,420,137 utilizes tetracene, PETN and aluminum along with others.

U.S. Pat. No. 5,167,736 utilizes DDNP, strontium nitrate, tetracene and calcium carbonate along with other elements such as as boron.

U.S. Pat. No. 5,216,199 utilizes DDNP, tetracene along with strontium nitrate.

U.S. Pat. No. 4,363,679 utilizes zinc oxide along with PETN and nitrocellulose.

U.S. Pat. No. 4,675,059 utilizes DDNP along with manganese dioxide and tetracene.

U.S. Pat. No. 4,581,082 utilizes zinc dioxide along with strontium and others.

EPO Patent No. 58048681 utilizes cupric oxide along with tetracene, calcium silicide and other materials.

The closest prior art within our knowledge is believed to be U.S. Pat. No. 3,707,411 which utilizes the combination of DDNP or tetracene, nitrocellulose, and PETN (pentaerythritol tetranitrate). This patent advocates the use of a single percussion-sensitive compound selected from the group consisting of a diazo, a triazole, and a tetrazole compound in combination with a mixture of nitrocellulose. It does not utilize a metallic oxidizing compound, but it discloses and claims the use of a single percussion-sensitive compound in combination with nitrocellulose and expressly specifies the exclusion of calcium silicide. As a consequence, the performance of the composition disclosed and claimed therein, as shown by tests which we have conducted, is less desirable than the performance accomplished through the use of our non-toxic composition as defined and claimed herein.

BRIEF SUMMARY OF THE INVENTION

We have discovered an improved non-toxic priming composition which provides improved ballistic data and can be made by utilizing nitrocellulose and/or a double-base smokeless propellant (Hercules Fines) with two diazo, triazole, or tetrazole compounds, preferably DDNP and tetracene. With these two primary percussion-sensitive explosives, we utilize calcium silicide as a "hot particle" producer, non-toxic frictionator, and non-explosive reaction moderator. The use of the two percussion-sensitive compounds improves both the sensitivity and the flame producing parameters.

The following mix is preferred:

| | |
|---|---|
| DDNP | 20–45% by weight |
| Tetracene | 10–30% by weight |
| Nitrocellulose or double-based propellant (such as Hercules Fines) | 10–30% by weight |
| Calcium silicide | 10–30% by weight |
| Gums | 0.2–1.0% by weight |

The above primer mix contains none of the toxic metals listed by the EPA list of toxic materials, or any of the metals listed on the FBI list of toxic metals. This list includes lead, barium, beryllium, antimony, cadmium, arsenic, chromium, selenium, tin, thallium, mercury, zinc and copper.

It will be noted that the nitrocellulose guncotton is what is termed a single-based propellant, whereas Hercules Fines is a double-based propellant in that it is comprised of both nitrocellulose and nitroglycerin. As indicated, either of these two propellants may be utilized, but the preferred and best component performance is provided through the use of Hercules Fines. We have found that the presence of calcium silicide in the amounts indicated does not present residue problems as discussed in U.S. Pat. No. 3,707,411.

The preferred mix at which we have arrived consists of 45% by weight of DDNP, 10% by weight of tetracene, 25% by weight of Hercules Fines, and 20% by weight of calcium silicide. It will be noted that neither guncotton nor PETN are included.

It will be seen from the above that our invention utilizes two percussion-sensitive explosives in combination with a suitable propellant and calcium silicide. 30–75% by weight of the mix is made up of the two primary explosives, DDNP and tetracene. 10–30% by weight is made up by calcium silicide. The remaining 10–30% by weight is a suitable propellant. By the term "suitable propellant," whenever used hereinafter, it is intended to connote either nitrocellulose or Hercules Fines. Hercules Fines is a finely divided propellant made up of nitrocellulose and nitroglycerin. The finely divided particles are important in that it ignites more readily and, therefore, provides the necessary heat. This product is readily available on the market and is well known in the art.

Our non-toxic primer composition is designed to eliminate a number of the problems of the prior art. First of all, it eliminates the use of those metallic oxidizing compounds which are toxic or undesirable. It also eliminates the need for the use of reducing and oxidizing agents. In addition, it eliminates the use of hygroscopic oxidizers and thereby substantially reduces the likelihood of primer malfunctions. In addition, it substantially diminishes or eliminates the deposition of toxic or heavy metals on firearms, as well as the distribution of such metals into the atmosphere. Thus, it has both practical and environmental attributes.

DETAILED DESCRIPTION OF THE INVENTION

. In our earliest efforts, we utilized 20% by weight of DDNP, 30% by weight of tetracene, 30% by weight of calcium silicide, and 20% by weight of guncotton. We found this mixture to provide definite advantages, but we went on with many additional tests (in excess of 100) in our efforts to improve the mix. In doing so, we tested a composition consisting of 30% by weight of DDNP, 30% by weight of tetracene, 30% by weight of Hercules Fines, and 10% by weight of PETN. Thus, we substituted PETN and altered the amount of DDNP to produce more heat. We also substituted Hercules Fines for nitrocellulose, in our efforts to facilitate ignition. The results of these tests were not as favorable as desired and, therefore, we continued our tests until we reached the preferred mix as described above.

As indicated above, in our earliest form of the invention, we discovered that the combination of 20% by weight of DDNP, 30% by weight of tetracene, and 20% by weight of guncotton, when mixed with 30% by weight of calcium silicide, provided definite improved performances. The tetracene and DDNP provided the primary explosive function, the nitrocellulose or guncotton functioned as a fuel, and the calcium silicide provided hot particles and functioned as a frictionator.

As indicated above, we suspected that the calcium silicide, when used in the indicated proportions, may have been impairing the ignition of the primer mix. In seeking to solve this problem, we sought to find a suitable substitute which would ignite and burn more readily. In doing so, we went to 30% by weight of Hercules Fines in the belief that this finely divided fuel would perform in an improved manner. This proved to be true, but the use of PETN was not found to be satisfactory, in that the performance of the mix did not meet our expectations and goals.

As a consequence of the above, we made many additional tests and have finally arrived at the preferred mix of 45% by weight of DDNP, 10% by weight of tetracene, 25% by weight of Hercules Fines, and 20% by weight of calcium silicide. Thus, we have found that we can utilize less Hercules Fines than that used in earlier tests, because of the finely divided nature and energy of that propellant. Photos of nitrocellulose and Hercules Fines, when compared, show that the latter have particle size larger than those of nitrocellulose. Also, photos of Ball Powder, as described in some of the above patents, show that the particles thereof are substantially greater than both nitrocellulose and Hercules Fines, but have less surface area per unit volume due to their rounded configuration.

As described above, we utilize two primary explosives, namely, DDNP and tetracene. We believe that the use of two such highly energetic materials might be too brisant without the use of calcium silicide as an explosive moderator. Since that time, we have found that calcium silicide, when used in the indicated percentage (20% by weight), functions well as a frictionator and provider of hot particles without leaving residue in objectionable amounts.

We have found that our new non-toxic primer mix constitutes a significant advancement over all previous primer mixes because it produces completely non-toxic ignition products. In addition, it provides definitely improved propellant ignition over no-metal priming mixes. Also, since it does not contain any hygroscopic compounds, it diminishes or precludes misfires and other primer malfunctions.

It will, of course, be understood that various changes may be made in the form, details, arrangement and proportions of the parts without departing from the scope of the invention which comprises the matter shown and described herein and set forth in the appended claims.

We claim:

1. A non-toxic primer composition for small arms centerfire cartridges which is void of metallic oxidizing compounds and of hygroscopic compounds, comprising: a mixture of about 10–30% by weight of a suitable propellant; approximately 30–75% by weight of at least two percussion-sensitive compounds selected from a group consisting of a diazo, a triazole and a tetrazole compound; and 10–30% by weight calcium silicide.

2. The non-toxic primer composition defined in claim 1, wherein the suitable propellant is nitrocellulose.

3. The non-toxic primer composition defined in claim 1, wherein the suitable propellant consists of a finely ground double based propellant.

4. The non-toxic primer composition defined in claim 1, wherein the suitable propellant consists of Hercules Fines.

5. The non-toxic primer composition defined in claim 4, wherein the proportion of Hercules Fines contained therein approximates 10–25% by weight.

6. The non-toxic primer composition defined in claim 4, wherein the proportion of Hercules Fines contained therein approximates 25–30% by weight.

7. The non-toxic primer composition defined in claim 4, wherein the proportion of Hercules Fines contained therein approximates 25% by weight.

8. The non-toxic primer composition defined in claim 1, wherein said suitable propellant consists of approximately 20% by weight of nitrocellulose.

9. The non-toxic primer composition defined in claim 1, wherein one of said two percussion-sensitive compounds is tetracene.

10. The non-toxic primer composition defined in claim 1, wherein one of said percussion-sensitive compounds consists of approximately 10–30% by weight of tetracene.

11. The non-toxic primer composition defined in claim 1, wherein one of said two percussion-sensitive compounds consists of approximately 10% by weight of tetracene.

12. The non-toxic primer composition defined in claim 1, wherein one of said two percussion-sensitive compounds consists of approximately 20% by weight of tetracene.

13. The non-toxic primer composition defined in claim 1, wherein one of said two percussion-sensitive compounds consists of approximately 30% by weight of tetracene.

14. The non-toxic primer composition defined in claim 1, wherein one of said two percussion-sensitive compounds is diazodinitrophenol.

15. The non-toxic primer composition defined in claim 1, wherein one of said percussion-sensitive compounds consists of approximately 20–45% by weight of diazodinitrophenol.

16. The non-toxic primer composition defined in claim 1, wherein one of said two percussion-sensitive compounds consists of approximately 20% by weight of diazodinitrophenol.

17. The non-toxic primer composition defined in claim 1, wherein one of said two percussion-sensitive compounds consists of approximately 30% by weight of diazodinitrophenol.

18. The non-toxic primer composition defined in claim 1, wherein one of said two percussion-sensitive compounds consists of approximately 45% by weight of diazodinitrophenol.

19. The non-toxic primer composition defined in claim 1, wherein said two percussion-sensitive compounds consist of tetracene and diazodinitrophenol.

20. The non-toxic primer composition defined in claim 1, wherein said two percussion-sensitive compounds consist of about 10–30% tetracene and about 20–45% diazodinitrophenol.

21. The non-toxic primer composition defined in claim 1, wherein said two percussion-sensitive compounds consist of about 10% tetracene and about 45% diazodinitrophenol.

22. The non-toxic primer composition defined in claim 1, wherein said two percussion-sensitive compounds consist of about 10% by weight tetracene and about 45% by weight of diazodinitrophenol and the propellant consists of approximately 25% by weight of Hercules Fine.

23. The non-toxic primer composition defined in claim 1, wherein said two percussion-sensitive compounds consist of about 10–30% by weight of tetracene and about 20–45% by weight of diazodinitrophenol and the proportion by weight of calcium silicide approximates 20%.

24. The non-toxic primer composition defined in claim 1, wherein the proportion of calcium silicide contained therein approximates 10% by weight.

25. The non-toxic primer composition defined in claim 1, wherein the proportion of calcium silicide contained therein approximates 30% by weight.

26. The non-toxic primer composition defined in claim 1, wherein the proportion of calcium silicide contained therein approximates 10–20% by weight.

27. The non-toxic primer composition defined in claim 1, wherein the proportion of calcium silicide contained therein approximates 20–30% by weight.

28. A non-toxic primer composition for small arms centerfire cartridges which is void of metallic oxidizing compounds and of hygroscopic compounds, comprising:

a mixture of approximately 10–30% by weight of Hercules Fines; approximately 30–75% by weight of two percussion-sensitive compounds selected from the group consisting of diazo, a triazole and a tetrazole compound, and 10–30% by weight of calcium silicide.

29. A non-toxic primer composition which is void of metallic oxidizing compounds and of hygroscopic compounds, comprising:

a mixture of approximately 10–30% by weight of a suitable propellant;

approximately 20–45% by weight of diazodinitrophenol;

approximately 10–30% by weight of tetracene; and approximately 10–30% by weight of calcium silicide.

30. A non-toxic primer composition for small arms centerfire cartridges which is void of metallic oxidizing compounds and of hygroscopic compounds, comprising:

a mixture of approximately 45% by weight of diazodinitrophenol;

approximately 10% by weight of tetracene;

approximately 25% by weight of Hercules Fines; and approximately 20% by weight of calcium silicide.

31. A non-toxic primer composition for small arms centerfire cartridges which is void of metallic oxidizing compounds and of hygroscopic compounds, comprising:

a mixture of approximately 20–45% by weight of diazodinitrophenol;

approximately 10–30% by weight of tetracene;

approximately 10–30% by weight of Hercules Fines; and approximately 10–30% of a non-toxic frictional agent.

32. The non-toxic primer composition defined in claim 1, wherein said suitable propellant consists of approximately 10–20% by weight of nitrocellulose.

33. The non-toxic primer composition defined in claim 1, wherein said suitable propellant consists of approximately 20–30% by weight of nitrocellulose.

* * * * *